US012716172B2

(12) United States Patent
Heiskanen et al.

(10) Patent No.: US 12,716,172 B2
(45) Date of Patent: Aug. 25, 2026

(54) METHOD FOR PRODUCING A MACHINE GLAZED PAPER COMPRISING MICROFIBRILLATED CELLULOSE AND A MACHINE GLAZED PAPER

(71) Applicant: Stora Enso OYJ, Helsinki (FI)

(72) Inventors: Isto Heiskanen, Imatra (FI); Kaj Backfolk, Lappeenranta (FI); Anna Kauppi, Lappeenranta (FI); Juha Korvenniemi, Oriniemi (FI); Jukka Kankkunen, Imatra (FI)

(73) Assignee: Stora Enso OYJ, Helsinki (FI)

( * ) Notice: Subject to any disclaimer, the term of this patent is extended or adjusted under 35 U.S.C. 154(b) by 254 days.

(21) Appl. No.: 18/042,115

(22) PCT Filed: Aug. 31, 2021

(86) PCT No.: PCT/IB2021/057941

§ 371 (c)(1),
(2) Date: Feb. 17, 2023

(87) PCT Pub. No.: WO2022/049483

PCT Pub. Date: Mar. 10, 2022

(65) Prior Publication Data

US 2023/0243099 A1 Aug. 3, 2023

(30) Foreign Application Priority Data

Sep. 1, 2020 (SE) ..... 2051028-5

(51) Int. Cl.

| | |
|---|---|
| ***D21F 11/04*** | (2006.01) |
| ***D21H 11/18*** | (2006.01) |
| ***D21H 19/12*** | (2006.01) |
| ***D21H 21/16*** | (2006.01) |
| ***D21H 27/30*** | (2006.01) |

(52) U.S. Cl.
CPC ..... *D21F 11/04* (2013.01); *D21H 11/18* (2013.01); *D21H 19/12* (2013.01); *D21H 21/16* (2013.01); *D21H 27/30* (2013.01)

(58) Field of Classification Search
CPC ..... D21H 11/18; D21H 19/12; D21H 21/16; D21H 27/30; D21H 19/72; D21H 25/005; D21H 27/00; D21H 25/04; D21F 11/04
See application file for complete search history.

(56) References Cited

U.S. PATENT DOCUMENTS

| | | | | |
|---|---|---|---|---|
| 2,999,787 | A | 9/1961 | Downs et al. | |
| 2002/0048674 | A1 | 4/2002 | Taipale | |
| 2004/0062907 | A1 | 4/2004 | Lindsay et al. | |
| 2012/0080156 | A1 | 4/2012 | Laleg et al. | |
| 2012/0241114 | A1 | 9/2012 | Axrup et al. | |
| 2015/0096700 | A1* | 4/2015 | Heiskanen | D21H 11/02 162/174 |
| 2016/0024718 | A1* | 1/2016 | Lee | D21H 11/18 162/157.6 |
| 2016/0273165 | A1 | 9/2016 | Laine et al. | |
| 2017/0073893 | A1* | 3/2017 | Bilodeau | D21D 1/306 |
| 2018/0245289 | A1* | 8/2018 | Heiskanen | D21H 19/36 |
| 2018/0248988 | A1 | 8/2018 | Garrity et al. | |
| 2018/0313038 | A1 | 11/2018 | Bradbury et al. | |
| 2019/0177919 | A1 | 6/2019 | Husband et al. | |
| 2020/0023627 | A1 | 1/2020 | Heiskanen et al. | |
| 2020/0140634 | A1 | 5/2020 | Ziegenbein | |
| 2020/0173109 | A1 | 6/2020 | Saukkonen et al. | |
| 2020/0216681 | A1* | 7/2020 | Qin | D06N 3/02 |

FOREIGN PATENT DOCUMENTS

| | | | | |
|---|---|---|---|---|
| CN | 109415519 | A | 3/2019 | |
| CN | 110088401 | A | 8/2019 | |
| CN | 111304967 | A | 6/2020 | |
| EP | 2669432 | A1 | 12/2013 | |
| EP | 2781652 | A1 | 9/2014 | |
| EP | 3202979 | A1 * | 8/2017 | D21H 25/04 |
| WO | 2009153225 | A1 | 12/2009 | |
| WO | 2017134088 | A1 | 8/2017 | |
| WO | 2018002815 | A1 | 1/2018 | |
| WO | 2018116223 | A1 | 6/2018 | |
| WO | 2018211441 | A1 | 11/2018 | |
| WO | 2020095254 | A1 | 5/2020 | |

OTHER PUBLICATIONS

Fapel OY, Book 8, Papermaking Part 1, Stock Preparation and Wet End, ISBN: 952-5216-08-X.
Markaryd Compendium X-710, Drying of Paper and Cardboard, 1999, 5.10 Drying with yankee cylinder Torking AV, Papper Och Kartong.
Interrelation among air-leak-smoothness methods, scanned on Mar. 1, 2007.
Opposition filed against corresponding Swedish Priority application No. SE 2051028-5 on Sep. 4, 2024.
Extended European Search Report from corresponding European application No. EP21863805.4 dated Sep. 5, 2024.
International Search Report from corresponding PCT application No. PCT/US2021/057941 mailed Nov. 1, 2021.
Gary Chinga-Carrasco, Cellulose fibres, nanofibrils and microfibrils: The morphological sequence of MFC components from a plant physiology and fibre technology point of view, Chinga-Carrasco Nanoscale Research Letters, 2011, 6:417.

(Continued)

*Primary Examiner* — Abbas Rashid
*Assistant Examiner* — Elisa H Vera
(74) *Attorney, Agent, or Firm* — Greer, Burns & Crain, Ltd.

(57) ABSTRACT

The present invention relates to a method for producing a machine glazed paper comprising microfibrillated cellulose, wherein the method comprises the steps of: providing a suspension comprising between 0.1 wt-% to 50 wt-% of microfibrillated cellulose based on total dry weight, forming a fibrous web of said suspension on a wire wherein said web has a dry content of 1-25% by weight, dewatering the fibrous web in at least one dewatering unit, glazing at least one side of the dewatered fibrous web in a glazing unit to form the machine glazed paper. The invention further relates to a MG paper produced according to the method.

19 Claims, No Drawings

(56) References Cited

OTHER PUBLICATIONS

D. Fengel, Ultrastructural behaviour of cell wall polysaccharides, TAPPI, 1970, vol. 53, No. 3, pp. 497-503.
Peter J. Walker, High temperature Yankee Hoods Save Energy and Improve Quality, P&P, Jul. 2007.
Notice from Swedish Patent Office for priority application No. SE-251028-5, dated Mar. 23, 2023.

* cited by examiner

METHOD FOR PRODUCING A MACHINE GLAZED PAPER COMPRISING MICROFIBRILLATED CELLULOSE AND A MACHINE GLAZED PAPER

This application is a U.S. National Phase under 35 U.S.C. § 371 of International Application No. PCT/IB2021/057941 filed Aug. 31, 2021, which claims priority under 35 U.S.C. §§ 119 and 365 to Swedish Application No. 2051028-5 filed Sep. 1, 2020.

TECHNICAL FIELD

The present invention relates to a method for producing a machine glazed paper comprising microfibrillated cellulose and a machine glazed paper comprising microfibrillated cellulose produced according to the method.

BACKGROUND

Machine glazed (MG) paper is a paper used in label paper, special printing application and in different food and hygiene packaging applications. Normally, one surface of the paper is glazed, i.e. treated in such a way that the gloss of the surface of the paper is increased. The glazing of the at least one surface of the paper is done in order to provide the paper with improved gloss and increased surface density without losing too much bulk. The glazed surface improves the barrier properties, especially improved barrier against grease and oil as well as it gives the surface improved printing properties.

Besides having good barrier properties, it is important that the MG paper also has good mechanical strength in order for it to cope with the high demands in the end packaging applications.

Microfibrillated cellulose (MFC) is known to be used as a strength additive or barrier additive when producing paper or paperboard products. However, MFC has a very high water binding capacity and it is thus very difficult to reduce the water content of a slurry comprising microfibrillated cellulose and the dewatering demand for a product comprising high amounts of MFC is very high. Thus, it is difficult to dewater a product comprising high amounts of MFC without deteriorating the mechanical or barrier properties of the product.

During production of machine glazed paper it is important that the runnability of the paper is improved. By adding barrier or strength additives to the paper there is a risk with lifting or blistering of the web during drying.

There is thus a need for a new method to produce an improved MG paper having good strength and barrier properties in an efficient way.

SUMMARY

It is an object of the present invention to provide a method for producing a machine glazed paper comprising microfibrillated cellulose in an efficient way without negatively affecting the strength and barrier properties of the paper, which method further eliminates or alleviates at least some of the disadvantages of the prior art methods.

The invention is defined by the appended independent claims. Embodiments are set forth in the appended dependent claims and in the following description.

The present invention relates to a method for producing a machine glazed paper comprising microfibrillated cellulose, wherein the method comprises the steps of: providing a suspension comprising between 0.1 wt-% to 50 wt-% of microfibrillated cellulose based on total dry weight, forming a fibrous web of said suspension on a wire wherein said web has a dry content of 1-25% by weight, dewatering the fibrous web in at least one dewatering unit, glazing at least one side of the dewatered fibrous web in a glazing unit to form the machine glazed paper.

It has been found that it is possible produce a machine glazed paper with good strength and barrier properties by the use of microfibrillated cellulose. MG paper is a quite high density paper so it was surprisingly found possible to add quite high amounts of MFC to the suspension and still be able to produce a MG paper having good strength and barrier properties at a high production speed, i.e. the combination of the dewatering unit and the glazing unit made it possible to still dewater and dry the fibrous web in an efficient way.

The dewatering unit is preferably a shoe press, a belt press or similar extended nip pressing equipment with a nip length of at least 150 mm. It was found that the use of a shoe press, belt press or similar extended nip pressing equipment and a glazing unit made it possible to improve the dewatering of the web without destroying the barrier properties of the fibrous web.

The glazing unit may be a Yankee cylinder, a glassine calender or an extended nip calender such as a shoe calender or belt calender. The glazing unit is preferably a Yankee cylinder. It was found that the use of a Yankee cylinder as a glazing unit and the dewatering unit made it possible to both dry and provide the at least one surface of the fibrous web with a glazed surface in an efficient way.

The fibrous web may be calendered in a calender after being conducted through the glazing unit. Any know calender can be used. It is possible to calender one or both sides of the machine glazed paper.

The fibrous web preferably has a dry content between 25-45 wt-% after being conducted through the at least one dewatering unit. The fibrous web preferably has a dry content above 35 wt-% before being treated in the glazing unit, preferably above 45 wt-%. The dry content of the fibrous web before being treated in the glazing unit is preferably below 85 wt-%, more preferably between 35-85 wt-% or even more preferred between 45-85 wt-%. By using the mentioned solid contents of the fibrous web before being treated in the dewatering unit and the glazing unit, a machine glazed paper with improved strength, good barrier properties and be produced in an efficient way.

The suspension may also comprise a hydrophobizing chemical such as AKD, ASA or rosin size in an amount of 0.1-10 kg/ton, preferably 0.1-5 kg/ton and more preferably 0.2-2 kg/ton based on dry weight. By adding an hydrophobizing chemical to the suspension as an internal sizing agent the barrier properties of the machine glazed paper is improved. It was also found that the combination of MFC and hydrophobizing chemical improved the adhesion of the web to the glazing unit which improved the runnability of the process The fibrous web may comprise more than one layer comprising microfibrillated cellulose. In this way a multiply paper comprising more than one layers comprising microfibrillated cellulose is formed. The fibrous web comprising more than one layers comprising microfibrillated cellulose can be formed by subjecting at least two suspensions comprising microfibrillated cellulose to a wire. The at least two suspensions may be added to the wire either in a multiply headbox or by the use of two different headboxes. The at least two suspensions whereof at least one of the suspensions comprises microfibrillated cellulose are applied to said wire so that the first suspension applied onto the wire, i.e. in direct contact with said wire and the other suspension is applied onto the applied first suspension. In this way a multiply fibrous web is formed. It may also be possible to attach two or more fibrous webs together after formation on a wire, to form a multiply paper product, i.e. a first fibrous web is formed on a first wire from a first headbox and a second fibrous web is formed on a wire support from a second headbox. The first and second fibrous webs are thereafter attached to each other to form a multiply fibrous web. Consequently, it is also possible to produce a multiply fibrous web by using two, three or more headboxes and wires and then attach the fibrous webs produced to each other and conduct the multiply fibrous web comprising more than one fibrous web through a dewatering unit and a glazing unit to produce the machine glazed paper. It might be preferred to produce a three layer machine glazed paper where only the suspension forming the midply of the MG paper comprises MFC. In this way the amount of MFC in the midply can be increased, which will improve the strength and barrier properties of the paper without the drawback with release or not enough adhesion to the surface of the glaze unit.

The produced machine glazed paper is preferably coated on at least one side with a coating composition. The coating composition preferably comprises water-soluble polymers such as cellulose, starch, nanocellulose, cellulose derivatives, such as carboxymethyl cellulose, starch derivatives, polyvinyl alcohol or polyvinyl alcohol derivatives, or combinations thereof. The said suspension might further comprise performance or functional chemicals such as cross-linkers, nanofillers or softening agents. It is preferred that the coating is applied to the glazed surface of the MG paper. The coating composition will further improve the barrier properties of the paper. It was surprisingly found that the addition of MFC to the paper improved the coating properties of the paper, i.e. the coverage of the coating on the surface of the paper is strongly improved. One theory is that the density of the glazed surface is increased meaning that the coating "stays" on the surface of the paper and it is possible to reduce the coating amount and still be able to achieve an even coating on the surface. It is preferred that the coating is applied in amount of 0.1-5 gsm, preferably between 0.2-4 gsm and even more preferred between 0.3-3 gsm.

The present invention further relates to a machine glazed paper produced according to the method above comprising 0.1-50 wt-% of microfibrillated cellulose. The machine glazed paper preferably has an Oxygen Transmission Rate (OTR) value (23° C., 50% RH) below 200 cc/m$^2$/24 h according to ASTM D-3985, a grammage between 25-160 gsm, a Gurley Hill value of at least 25000 s/100 ml, and more preferably at least 40 000 s/100 ml, as measured according to standard ISO 5636/6, at least one glazed surface with a surface roughness PPS value below 5 μm according to ISO 8791-4, preferably below 2 μm (before addition of any eventual coating), a KIT value of at least 6, more preferably above 8 and a Scott Bond of value above 1500 J/m$^2$, more preferably higher than 1600 J/m$^2$ and most preferably higher than 1800 J/m$^2$ measured according to TAPPI UM-403 on a 60 gsm paper.

DETAILED DESCRIPTION

With the present invention it was found possible to produce a machine glazed paper comprising MFC having improved strength, good barrier properties still at a high production speed. Since the dewatering process often is the most challenging process step for the production of a paper product comprising high amounts of MFC, the production speed of the entire product line can also be improved by improving the dewatering process. It was surprisingly found that the combination of a dewatering unit, preferably by using an extended nip pressing equipment such as a shoe press in followed by a glazing unit, preferably a Yankee Cylinder made it possible to produce a machine glazed paper comprising microfibrillated cellulose in a good and efficient way.

The suspension comprises between 0.1 wt-% to 50 wt-% of microfibrillated cellulose based on total dry weight, preferably between 2-40 wt-% or even more preferred between 5-30 wt-% of MFC based on the total dry weight. Besides MFC the suspension also comprises cellulosic fibers, preferably chemical pulp based fibers, such as kraft pulp fibers. The suspension may also comprise mechanical pulp fibers or chemothermomechanical (CTMP) pulp fibers. The suspension preferably comprises 50-99.9- wt-% of cellulosic fibers based on the total dry weight, preferably between 60-98 wt-% or even more preferred between 70-95-wt-%. The fibers may be hardwood or softwood fibers. The cellulosic fibers in the suspension, i.e. both the "normal" fibers and the MFC, may be bleached to produce a white paper product or unbleached to produce a brown paper product.

The microfibrillated cellulose of the suspension preferably has a Schopper-Riegler (SR) value above 80, preferably above 90, even more preferably above 95, preferably between 90-100 or even more preferred between 95-100 as determined by standard ISO 5267-1. Consequently, the suspension preferably comprises a fine grade MFC quality which normally is very difficult to dewater.

The suspension may also comprise a hydrophobizing chemical such as AKD, ASA or rosin size in an amount of 0.1-10 kg/ton, preferably 0.1-5 kg/ton and more preferably 0.2-2 kg/ton based on dry weight. By adding an hydrophobizing chemical to the suspension as an internal sizing agent the barrier properties of the machine glazed paper is improved. It was found that the combination of MFC and hydrophobizing chemical improved the adhesion of the web to the glazing unit which then improved the runnability of the process The suspension may also comprise additives such as native starch or starch derivatives, cellulose derivatives such as sodium carboxymethyl cellulose, a filler, retention and/or drainage chemicals, flocculation additives, deflocculating additives, dry strength additives, softeners, cross-linking aids, dyes and colorants, wet strength resins, fixatives, de-foaming aids, microbe and slime control aids, or mixtures thereof.

The wire is preferably a wire in a paper or paperboard machine and the dewatering and production of the machine glazed paper is preferably done in a paper machine .A paper machine (or paper-making machine) is an industrial machine which is used in the pulp and paper industry to create paper in large quantities at high speed. Modern paper-making machines are typically based on the principles of the Fourdrinier Machine, which uses a moving woven mesh, a "wire", to create a continuous web by filtering out the fibers held in a pulp suspension and producing a continuously moving wet web of fiber. This wet web is dried in the machine to produce a strong paper web.

A fibrous web of said suspension is formed on a wire wherein said web has a dry content of 1-25% by weight. The fibrous web is thereafter further dewatered or drained on the wire by any known method. The further dewatering typically comprises pressing the web to squeeze out as much water as possible. The further dewatering may for example include passing the formed multilayer web through a press section of a paper machine, where the web passes between large rolls loaded under high pressure to squeeze out as much water as possible. The removed water is typically received by a fabric or felt. The fibrous web is thereafter conduced trough at least one dewatering unit. The fibrous web preferably has a dry content between 25-45 wt-% after being conducted through the at least one dewatering unit. The fibrous web being dewatered in the dewatering unit is thereafter conducted through a glazing unit. It is preferred that the fibrous web has a dry content above 35 wt-% before being treated in the glazing unit, preferably above 45 wt-%. The dry content of the fibrous web before being treated in the glazing unit is preferably below 85 wt-%, more preferably between 35-85 wt-% or even more preferred between 45-85 wt-%. By using the mentioned solid contents of the fibrous web before being treated in the dewatering unit and the glazing unit, a machine glazed paper with improved strength, good barrier properties and be produced in an efficient way.

The dewatering unit is preferably a shoe press, a belt press or similar extended nip pressing equipment with a nip length of at least 150 mm. It was found that the use of a shoe press, belt press or similar extended nip pressing equipment made it possible to improve the dewatering of the web without increasing the risk for wet blistering of the web and destroying the barrier properties of the fibrous web.

The extended nip pressing equipment preferably has a nip length of at least 150 mm, preferably at least 200 mm, preferably between 150-350 mm, and even more preferred between 200 and 300 mm.

The linear load in expended nip pressing equipment is preferably between 250-1500 kN/m, i.e. this is the maximum linear load to be used in the equipment, e.g. the shoe press. It is preferred that the linear load used is changed during the treatment of the fibrous web. By gradually or stepwise increasing the linear load in the extended nip pressing equipment, the dewatering of the web is improved, i.e. a web with a higher dry content can be produced without destroying the barrier properties. It is also possible that the linear load is increased at a pulse during treatment in the nip, i.e. the linear load is increased at least one time in at least one pulse during treatment of the fibrous web in the shoe pres. This can be repeated during treatment in the extended nip pressing equipment. If more than one extended nip pressing equipment, e.g. shoe presses, is used it is possible to use the same linear load profile in both equipment. However, it is often preferred to use different linear load profiles to design the linear load profile in such a way that the dewatering is improved without deteriorating the barrier properties of the dewatered web.

With shoe press is meant an extended nip pressing equipment comprising a shoe press nip. Any known shoe press can be used. The shoe press nip can either be formed by using a shoe and a roll or by using a large diameter soft roll and a roll. The roll preferably has a synthetic belt but it can also have a metal belt. The large diameter soft roll can have a diameter of 1.5-2 meters.

The position of the shoe in relation to the fibrous web can be changed by changing the tilt angle of the shoe press. The tilt angle of the at least one shoe press is preferably between 7-24 degrees. The tilt angle affects the peak linear load and is a way to adjust the linear load to improve the dewatering efficiency of the web.

The nip time is preferably at least 30 ms. Depending on the nip length and the production speed the time in which the fibrous material is subjected to the pressure in the shoe press varies.

With belt press is meant an extended nip pressing equipment comprising a belt. Any known belt presses can be used.

It may be preferred to use at least two extended nip pressing equipment, preferably at least two shoe presses, and that the two extended nip pressing equipment are being located after each other. The fibrous web is then first conducted through a first shoe press and then through the second shoe press. In this way it was found possible to even further improve the dewatering of the fibrous web and still be able to produce a paper with good barrier properties. The nip pressure used in the first shoe press is preferably lower than the nip pressure used in the second shoe press. The at least two shoe presses are preferably located at different sides of said fibrous web. In this way it is possible to dewater the web from both directions through the fibrous web. When more than one shoe press is used is it preferred that the total nip length, i.e. the sum of the nip lengths of each shoe press, is above 350 mm, preferably above 400 mm and even more preferred above 450 mm. The geometric design of the at least two shoe presses is preferably different, e.g. one shoe press can have a concave design and one shoe press can have a convex design.

The glazing unit may be a Yankee cylinder, a glassine calender or an extended nip calender such as a shoe calender or belt calender. The glazing unit is preferably a Yankee cylinder. It was found that the use of a Yankee cylinder as a glazing unit made it possible to both dry and provide the at least one surface of the fibrous web with a glazed surface. Yankee Cylinders are normally used for drying tissue papers that is a very porous material. The use of Yankee Cylinders and how the drying affects paper is well described by Walker, in the article "High temperature Yankee Hoods Save Energy and Improve Quality, P&P, July 2007. When using a Yankee Cylinder for drying products, the liquid in the products flows through the product towards the Yankee cylinder, i.e. towards the heat and the steam that is formed during the drying. The liquid of the product in our case also comprises microfibrils which leads to that an increased concentration of microfibrils is achieved on the smoothened and glazed surface of the paper.

The temperature of the glazing unit is preferably above 100° C., preferably between 110-190° C. The first side of the fibrous web be in direct contact with the glazing unit, e.g. in direct contact with the surface of the Yankee cylinder.

In order to control the adhesion of the fibrous web to the glazing unit, e.g. Yankee cylinder, it may be preferred to add adhesion control additives to the surface of the glazing unit. This has been showed to be more important when microfibrillated cellulose is used since the microfibrillated cellulose in the fibrous web tend to make the fibrous web too tense which causes lifting or blistering of the web from the surface of the glazing unit. The adhesion control additives will provide sufficient adhesion of the web to the surface of the glazing unit. Suitable adhesion control additives may be water-soluble or partly water-soluble polymers such as polyvinyl alcohol (PVOH), polyamide-amine derivate, polyethylene imine, polyacrylamide and/or polyacrylamide derivate. The degree of hydrolysis of the PVOH used is preferably less than 99%, even more preferred less than 98%. It is also possible to use modified polymers, such as modified PVOH, preferably ethylene, carboxylated, cationized or siliconized PVOH. The adhesion control additive may also comprise nanoparticles, such as nanoclay and/or nanocellulose. The adhesion control additive may also comprise between 0.5-20 wt-% of nanoparticles based on total dry weight. The amount of adhesion control additive to the surface of the glazing unit is preferably between 0.1-10 gsm. The adhesion control additive is preferably added to the surface of the glazing unit by spraying. The adhesion control additive is preferably added to the surface of the glazing unit as a solution or as a foam.

The fibrous web may be calendered in at least one calender after being conducted through the glazing unit. Any know calender can be used, such as machine calender, multi-nip calender, soft-nip calender, belt calender. It may be preferred to use a shoe calender or any other extended nip calender. It is possible to calender one or both sides of the machine glazed paper. The treatment in the calender is preferably done in-line.

The fibrous web may be treated in a de-curling unit after being calendered. In this way it is possible to even further reduce the curling tendency of the paper.

The fibrous web preferably comprises more than one layer of comprising microfibrillated cellulose. In this way a multiply paper comprising more than one layer comprising microfibrillated cellulose is formed. The fibrous web comprising more than one layer comprising microfibrillated cellulose can be formed by subjecting at least two suspensions comprising microfibrillated cellulose to a wire. The at least two suspensions may be added to the wire either in a multiply headbox or by the use of two different headboxes. It may also be possible to use other application methods as well, e.g. spray or curtain such as a flexJet headbox to create the multilayered fibrous web. The at least two suspensions comprising microfibrillated cellulose is applied to said wire so that the first suspension applied onto the wire, i.e. in direct contact with said wire and the other suspension is applied onto the applied first suspension. In this way a multiply fibrous web is formed. It may also be possible to attach two or more fibrous webs together after formation on a wire, to form a multiply paper product, i.e. a first fibrous web is formed on a first wire from a first headbox and a second fibrous web is formed on a wire support from a second headbox. The first and second fibrous webs are thereafter attached to each other to form a multiply fibrous web. The at least two suspensions comprising microfibrillated cellulose may comprise the same type, amount, consistency etc of microfibrillated cellulose or different types, amounts, consistencies etc of the at least two suspension may be used. The multilayer fibrous web may comprise two, three, four, five or more layers. Consequently, it is also possible to produce a multiply fibrous web by using two, three or more headboxes and wires and then attach the fibrous webs produced to each other and conduct the multiply fibrous web comprising more than one fibrous web through a dewatering unit and a glazing unit to produce the machine glazed paper.

The produced machine glazed paper is preferably coated on at least one side with a coating composition. The coating composition preferably comprises starch, carboxymethyl cellulose and/or microfibrillated cellulose. It is preferred that the coating is applied to the glazed surface of the MG paper. The coating composition will further improve the barrier properties of the paper. It was surprisingly found that the addition of MFC to the paper improved the coating properties of the paper, i.e. the coverage of the coating on the surface of the paper is strongly improved. One theory is that the density of the glazed surface is increased meaning that the coating "stays" on the surface of the paper and it is possible to reduce the coating amount and still be able to achieve a full coating coverage on the surface. It is preferred that the coating is applied in amount of 0.1-5 gsm, preferably between 0.2-4 gsm and even more preferred between 0.3-3 gsm. Any known coating techniques may be used to apply the coating composition to the surface of the paper.

The present invention further relates to a MG paper produced according to the method described herein. The MG paper comprises 0,1-50 wt-% of microfibrillated cellulose, preferably between 2-40 wt-% or even more preferred between 5-30 wt-%.

The machine glazed paper preferably has an Oxygen Transmission Rate (OTR) value (23° C., 50% RH) below 200 cc/m$^2$/24 h according to ASTM D-3985, preferably below 150 cc/m$^2$/24 h and even more preferred below 100 cc/m$^2$/24 h.

The MG paper preferably has a grammage between 25-160 gsm, preferably between 30-140 gsm or even more preferred between 40-130 gsm.

The MG paper preferably has a Gurley Hill value of at least 25 000 s/100 ml, preferably at least 40 000 s/100 ml, and more preferably at least 60 000 s/100 ml, as measured according to standard ISO 5636/6.

The MG paper preferably has at least one glazed surface with a surface roughness PPS value below 5 μm according to ISO 8791-4, preferably below 2 μm (before addition of any eventual coating).

The MG paper preferably has a Scott Bond value above 1500 J/m$^2$, more preferably above 1600 J/m$^2$ and most preferably above 1800 J/m$^2$ measured according to TAPPI UM-403 on a 60 gsm paper. Consequently, the MG paper produced has very high strength.

The MG paper will typically exhibit good resistance to grease and oil. Grease resistance of the paper is evaluated by the KIT-test according to standard ISO 16532-2. The test uses a series of mixtures of castor oil, toluene and heptane. As the ratio of oil to solvent is decreased, the viscosity and surface tension also decrease, making successive mixtures more difficult to withstand. The performance is rated by the highest numbered solution which does not darken the sheet after 15 seconds. The highest numbered solution (the most aggressive) that remains on the surface of the paper without causing failure is reported as the "kit rating" (maximum 12). In some embodiments, the KIT value of the MG paper is at least 6, preferably at least 8, and even more preferred at least 10, as measured according to standard ISO 16532-2.

The MG paper preferably has high repulpability. In some embodiments, the multilayer MG paper exhibits less than 30%, preferably less than 20%, and more preferably less than 10% reject, when tested as a category II material according to the PTS-RH 021/97 test method.

Microfibrillated cellulose (MFC) shall in the context of the patent application mean a nano scale cellulose particle fiber or fibril with at least one dimension less than 1000 nm. MFC comprises partly or totally fibrillated cellulose or lignocellulose fibers. The liberated fibrils have a diameter less than 1000 nm, whereas the actual fibril diameter or particle size distribution and/or aspect ratio (length/width) depends on the source and the manufacturing methods. The smallest fibril is called elementary fibril and has a diameter of approximately 2-4 nm (see e.g. Chinga-Carrasco, G., *Cellulose fibres, nanofibrils and microfibrils,: The morphological sequence of MFC components from a plant physiology and fibre technology point of view, Nanoscale research letters* 2011, 6:417), while it is common that the aggregated form of the elementary fibrils, also defined as microfibril (Fengel, D., *Ultrastructural behavior of cell wall polysaccharides, Tappi J.,* March 1970, Vol 53, No, 3.), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanocellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregrates and cellulose microfibril aggregates. MFC can also be characterized by various physical or physical-chemical properties such as large surface area or its ability to form a gel-like material at low solids (1-5 wt-%) when dispersed in water. The cellulose fiber is preferably fibrillated to such an extent that the final specific surface area of the formed MFC is from about 1 to about 200 m2/g, or more preferably 50-200 m2/g when determined for a freeze-dried material with the BET method.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to hydrolyse or swell fiber or reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CMC), aldehyde and/or carboxyl groups (cellulose obtained by N-oxyl mediated oxidation, for example "TEMPO"), or quaternary ammonium (cationic cellulose). After being modified or oxidized in one of the above-described methods, it is easier to disintegrate the fibers into MFC or nanofibrillar size or NFC.

The nanofibrillar cellulose may contain some hemicelluloses; the amount is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated. MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

In view of the above detailed description of the present invention, other modifications and variations will become apparent to those skilled in the art. However, it should be apparent that such other modifications and variations may be affected without departing from the spirit and scope of the invention.

The invention claimed is:

1. A method for producing a machine glazed paper comprising microfibrillated cellulose, wherein the method comprises the steps of:

providing a suspension comprising between 0.1 wt-% to 50 wt-% of microfibrillated cellulose based on a total dry weight, forming a fibrous web of said suspension on a wire wherein said fibrous web has a dry content of 1-25% by weight, dewatering the fibrous web in at least one dewatering unit, glazing at least one side of the dewatered fibrous web in a glazing unit to form the machine glazed paper, wherein the glazing unit comprises a Yankee cylinder, an extended nip calender, or a glassine calender, wherein the at least one side of the dewatered fibrous web is in direct contact with the glazing unit, and wherein the machine glazed paper has Gurley Hill value of at least 25000 s/100 ml, as measured according to standard ISO 5636/6.

2. The method as claimed in claim 1, wherein the dewatering unit comprises a shoe press, a belt press, or a nip press with a nip length of at least 150 mm.

3. The method according to claim 1, wherein the fibrous web is calendered in at least one calender after being conducted through the glazing unit.

4. The method according to claim 1, wherein the fibrous web has a dry content between 25-45 wt-% after being conducted through the at least one dewatering unit.

5. The method according to claim 1, wherein the fibrous web has a dry content above 35 wt-% before being treated in the glazing unit.

6. The method according to claim 1, wherein the suspension further comprises a hydrophobizing chemical in an amount of 0.1-10 kg/ton based on a dry weight.

7. The method according to claim 6 wherein the hydrophobizing chemical comprises alkyl ketene dimer (AKD), alkenyl succinic anhydride (ASA) or rosin size.

8. The method according to claim 1, wherein the fibrous web comprises more than one layer comprising microfibrillated cellulose.

9. The method according to claim 1, wherein the machine glazed paper is coated on at least one side with a coating composition.

10. The method according to claim 9 wherein the coating composition comprises a water-soluble polymer.

11. A machine glazed paper produced according to the method of claim 1, wherein the machine glazed paper comprises between 0.1-50 wt-% of microfibrillated cellulose.

12. The machine glazed paper according to claim 11 wherein the machine glazed paper has a grammage between 25-160 gsm.

13. The machine glazed paper according to claim 11, wherein the machine glazed paper has an Oxygen Transmission Rate (OTR) value (23° C., 50% RH) below 200 $cc/m^2/24$ h according to ASTM D-3985.

14. The machine glazed paper according to claim 11, wherein the machine glazed paper has at least one glazed surface with a surface roughness PPS value below 5 μm according to ISO 8791-4.

15. The machine glazed paper according to claim 11, wherein the machine glazed paper has a Scott Bond value above 1500 $J/m^2$ measured according to TAPPI UM-403 on a 60 gsm paper.

16. The machine glazed paper according to claim 11, wherein the machine glazed paper has a KIT value of at least 6 measured according to standard ISO 16532-2.

17. The method according to claim 1, wherein the fibrous web has a dry content above 45 wt-% before being treated in the glazing unit.

18. The method according to claim 1, wherein the fibrous web has a dry content between 45-85 wt-% before being treated in the glazing unit.

19. The method according to claim 1, wherein the machine glazed paper has Gurley Hill value of at least 40000 s/100 ml, as measured according to standard ISO 5636/6.

* * * * *